US008550330B2

(12) United States Patent
Black et al.

(10) Patent No.: US 8,550,330 B2
(45) **Date of Patent: *Oct. 8, 2013**

(54) INTEGRATED TAB HANGING FILE SYSTEM

(75) Inventors: Steven Charles Black, Hastings, MN (US); Duane Christensen, Hastings, MN (US); David Fasbender, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/172,971

(22) Filed: Jun. 30, 2011

(65) Prior Publication Data

US 2011/0253768 A1 Oct. 20, 2011

Related U.S. Application Data

(63) Continuation of application No. 11/833,389, filed on Aug. 3, 2007, now abandoned.

(60) Provisional application No. 60/835,373, filed on Aug. 3, 2006.

(51) Int. Cl.
*B65D 27/00* (2006.01)
*B42F 21/00* (2006.01)
*G09F 23/10* (2006.01)

(52) U.S. Cl.
USPC ..... 229/67.2; 40/359; 40/641

(58) Field of Classification Search
USPC ..... 229/67.1–67.4; 40/359, 641
See application file for complete search history.

(56) References Cited

U.S. PATENT DOCUMENTS

| | | | | |
|---|---|---|---|---|
| 1,064,000 | A * | 6/1913 | Neff | 229/67.2 |
| 1,115,216 | A | 10/1914 | Laviolette | |
| 1,308,471 | A | 7/1919 | Barker | |
| 1,601,041 | A * | 9/1926 | Rand | 40/360 |
| 2,039,752 | A | 5/1936 | Thomas | |
| 3,205,597 | A * | 9/1965 | Stern | 40/641 |
| 3,881,649 | A * | 5/1975 | Krautsack | 229/117.12 |
| 3,933,294 | A * | 1/1976 | Meenan et al. | 229/67.3 |
| 3,966,113 | A | 6/1976 | Tipton | |
| 4,014,434 | A | 3/1977 | Thyen | |
| 4,617,223 | A | 10/1986 | Hiscock et al. | |
| 4,910,066 | A | 3/1990 | Foisie | |
| 5,174,606 | A | 12/1992 | Hure | |
| 5,966,852 | A | 10/1999 | Drzewiecki | |
| 5,996,881 | A | 12/1999 | Smith | |
| 6,206,425 | B1 * | 3/2001 | Heyer | 281/29 |
| 6,209,778 | B1 | 4/2001 | Henrikson et al. | |
| D450,091 | S | 11/2001 | Henrikson et al. | |

(Continued)

OTHER PUBLICATIONS

"Tab Cut Filing Envelopes", Smead Catalog, p. 640, 2006.

*Primary Examiner* — Jes F Pascua
(74) *Attorney, Agent, or Firm* — Altera Law Group, LLC

(57) ABSTRACT

An integral tab system for a 2-D or 3-D tab for a folder, and a method of making same is disclosed. The integral 2-D (flat) tab (20) is provided in the hanging folder itself without the need for additional tabs being affixed. The 3-D tab version (120) is created by an extension which is folded onto itself so that one edge surface is at an angle relative to the panels of the file folder allowing it to be read from the side. These tabs may also be supplied in a detachable form.

10 Claims, 6 Drawing Sheets

(56) References Cited

U.S. PATENT DOCUMENTS

| | | | | |
|---|---|---|---|---|
| 6,332,285 | B1 | 12/2001 | Aaldenberg et al. | |
| 6,385,860 | B1 | 5/2002 | MacWilliams et al. | |
| 6,416,083 | B1 * | 7/2002 | Mercier | 283/81 |
| 6,453,589 | B1 | 9/2002 | Schwartz | |
| 6,764,101 | B2 | 7/2004 | MacWilliams et al. | |
| 7,536,812 | B1 * | 5/2009 | Fasbender | 40/359 |
| 7,850,062 | B2 * | 12/2010 | Christensen et al. | 229/67.1 |
| 7,900,813 | B2 * | 3/2011 | Dodson | 229/67.2 |
| 7,980,014 | B2 * | 7/2011 | Fasbender | 40/359 |
| 2001/0021339 | A1 | 9/2001 | Pacione | |
| 2002/0050711 | A1 | 5/2002 | MacWilliams et al. | |
| 2002/0089171 | A1 | 7/2002 | Silvestre | |
| 2004/0051296 | A1 | 3/2004 | MacWilliams et al. | |
| 2004/0195821 | A1 | 10/2004 | Ghent | |
| 2005/0022718 | A1 | 2/2005 | Weisenfeld | |
| 2005/0022719 | A1 | 2/2005 | Weisenfeld | |
| 2006/0016112 | A1 * | 1/2006 | McCarthy et al. | 40/641 |

* cited by examiner

INTEGRATED TAB HANGING FILE SYSTEM

CROSS REFERENCE TO RELATED APPLICATIONS

The present application is a continuation of Ser. No. 11/833,389 filed on 3 Aug. 2007, now abandoned, which claims the benefit of U.S. Provisional Application Ser. No. 60/835,373 filed on 3 Aug. 2006, the complete subject matter of which is hereby incorporated herein by reference in its entirety.

FIELD OF THE INVENTION

The present invention is directed to a system for marking the edges of folders or file folder-like products, and more particularly hanging folders with tabs.

BACKGROUND

File folders, hanging file folders and other paper storage systems are of great utility in an office setting. The most common storage system, the common manila folder, for example are widespread and relatively inexpensive, and have convenient tabs suitable for writing. For hanging folders however, the typical system for marking the top edge is to use a known insert product which carries the label-indicia. In the days when typewriters were easily available, one would type the indicia on an insert, put it into a carrier and install it on hanging folders in notches provided. With the disappearance of typewriters, the common solution is to handwrite these index tabs. Still the process of making an insert and putting it in a carrier and attaching the carrier is cumbersome.

In addition, typically tabbing systems are on the top or side of the file folder. Such systems require the user to have visual access to the tab at roughly a perpendicular/right angle relative to the folder. Otherwise the tab is invisible (i.e. only the thickness of the tab is visible, not the indicia (writing) on the tab itself, and thus the purpose of the tab is lost.

So a solution needs to be found to provide a simple way to mark a hanging folder without all the steps mentioned above and also to provide a tab which can be viewed at various angles.

There are other issues relevant to the solution of the present invention and they are detailed below.

BRIEF SUMMARY

The invention includes a hanging file folder having at least one panel surface having an edge, and portion of the edge including an extension, said extension being folded over to form an integral tab.

The invention also includes a hanging file folder having support bars with at least one panel surface having an edge, and a portion of the edge including an extension, the extension being folded over to form an integral tab.

The invention also includes a folder having at least one panel and having an edge, having an extension section extending from said edge of one panel beyond, said extension section including at least a partially rigid section connected to said attachment member having a pair of parallel fold lines on either side of thereof; a second attachment section extending from the rigid section at one of said fold lines; said second attachment member be affixed to said panel; so that said folder includes an integral three dimensional tab structure formed extending from said file folder.

The invention also includes an attachable tab for a file folder having at least one panel and having an edge and a pair of support bars, having an extension section capable of affixation to one panel at its edge, said extension section including a semi rigid section connected to said attachment member having a pair of parallel fold lines on either side of thereof; a second attachment section extending from said rigid section at one of said fold lines; said second attachment member be affixed to said panel so that said tab is affixed to said folder it forms an integral three dimensional tab structure formed extending from said file folder.

The invention also includes a tab having a plurality of flanges sized to be received within like mating receiving slots in said folder. The tab flanges may also include adhesive means.

The invention also includes a method of making a file folder and an integral tab having the steps of providing an extension piece extending beyond the portion extending from an edge of the folder, scoring the piece with two parallel scores, the space between the scores constituting one face of the tab; rigidifying the space between said scores, applying adhesive to a portion of the extension on either side of the scores adjacent said space; so that when said extension piece is folded along said scores, a 3-dimensional tab is formed and is attachable to said folder.

Reference should be had to the claims for a full understanding of the scope of the invention. The above summary is only illustrative.

DETAILED DESCRIPTION OF THE INVENTION

Figure 1:
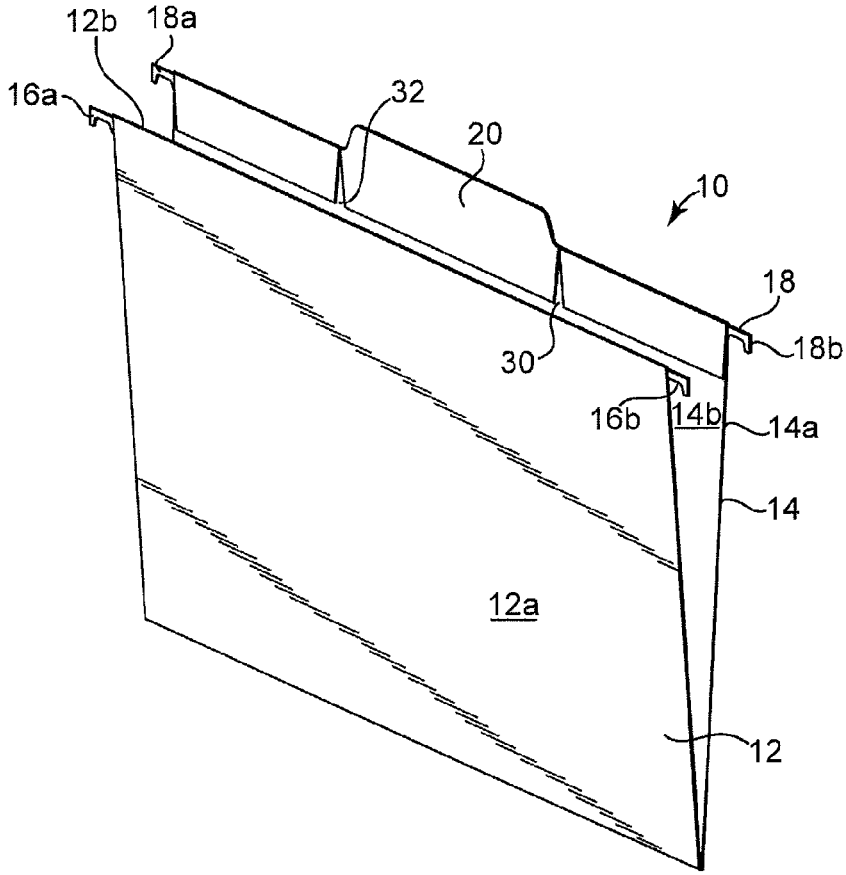
FIG. 1 is a perspective view of a hanging folder with a unitary/integral top tab attached.

The present invention is directed to an integrated tab system for a hanging folder. The tabs may be 2 or 3 dimensional. The term hanging folder is intended to encompass a range of other office requisites, such as binders, folios, clip boards, pockets and similar items, which are suspended in some fashion for ease of sliding. Typical suspension system use end or side hooks but this invention is not intended to be so limited. The term integrated or integral or unitary tabs are to mean that the tabs are supplied as part of the folder. They may be made as part of the folder material as a continuous web or attached to the folder web when fabricated. The user will however see the tab as part of the product at purchase and not have to assemble the tab section.

The invention discloses several embodiments, for example, a unitary folder with a flat tab, a 3 dimensional top tab and various methods of manufacture. Although not shown the invention includes a like system and method for making side or end tab folders or locating such tabs according to invention anywhere on the folder.

For the sake of brevity, the embodiments in the figures will be discussed simultaneously and the same reference numerals will be used whenever the elements are the same or similar.

Figure 2:
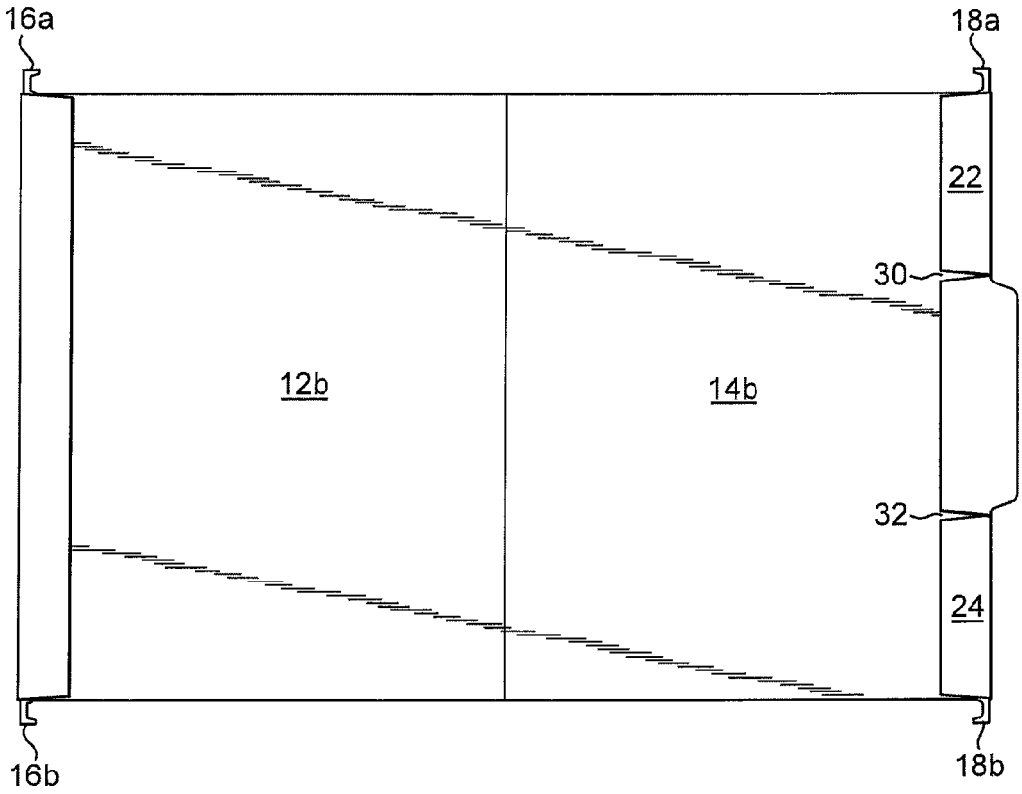
FIG. 2 is a plan view of a folder with integral tab attached, in an open inside layout.
Figure 3:
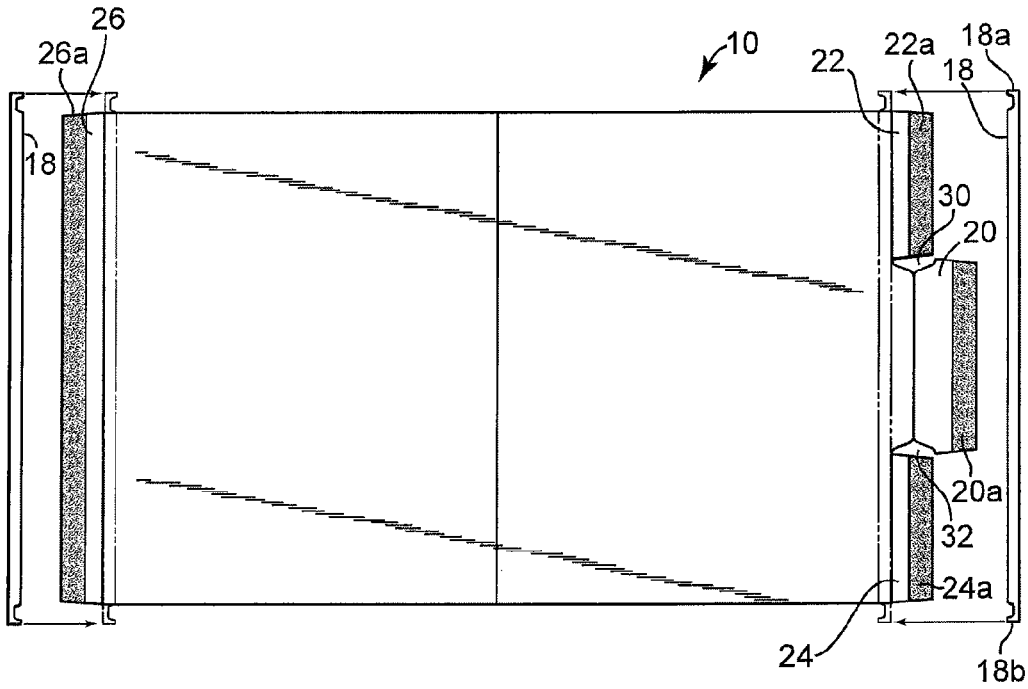
FIG. 3 is a view like FIG. 2 with portions unfolded and a hanging bar shown installed and removed.

FIGS. 1-3 illustrates a hanging folder 10 having a front and back face 12, 14, each of which have inner and outer faces designed at 12*a*, 12*b*, and 14*a*, 14*b*, respectively. In this construction of a hanging folder, each face optionally includes a support bar 16, 18 having hooks 16*a*, 16*b* and 18*a*, 18*b* respectively. The folder shown in the Figures is a so called top tab. The invention also includes other formulations including side, bottom or end tab configurations.

In this embodiment shown, the tab 20 is a center top tab, with two peripheral folded over sections The folder is typically made on a continuous web of material which is cut into sheets of appropriate length and then trimmed to form the folder blank which is shown in FIG. 3. In this figure, a center tab is shown, but it can also be made with a right or left tab but modifying the die cut as would be understood by a person skilled in the art. In the preferred embodiment, tab 20 has an adhesive portion 20*a*, as to the other non-tab portions 22*a* and 24*a* of portions 22 and 24. On the other leaf of the folder, portion 26 has an adhesive portion 26*a* and is to be folded over so as to immobilize bars 18. The adhesive can be replaced with any form of bond which holds the folded over portions to the leaves and secures the tabs and/or bars.

In order to prevent manufacturing defects and for other reasons, it is preferable to create a gap between adjoining portions. Cutting a notch 30, 32 is one solution. The notches are preferably formed as v-shaped cut outs (such as die-cuts) from adjacent portions, such as 20, 22. These can also be seen in their folded position in FIG. 1.

A further embodiment not shown, except in part in the existing figures, is where a folding tab 20 can be supplied in place of portions 22 and/or 24. This would allow the user to elect which tab was to be the "prominent" one and simply fold one or two of the other tabs 20 flush with the folder edge line (typically where the bar resides). The result would be folder where the tab position is user selectable. In this embodiment the manufacturer only has to supply one version of the folder to provide the user with choices of which tab they prefer to utilize. For safety reasons, the manufacturer may decide to supply the middle position as sealed with a flap like 20 or 22 to be sure that the bar is secure, but if no bar is employed, this would be quite unnecessary. The folder may include a plurality of spaced apart extensions along said edge, each of said extension being scored for folding in a first position, generally flush with said edge or a second position with an extension portion extending beyond said edge, allowing a user to selective fold said extension to produce one or more tabs visibly extending beyond said edge.

The same system is applicable to the 3 dimensional tab structure described below.

Figure 4:
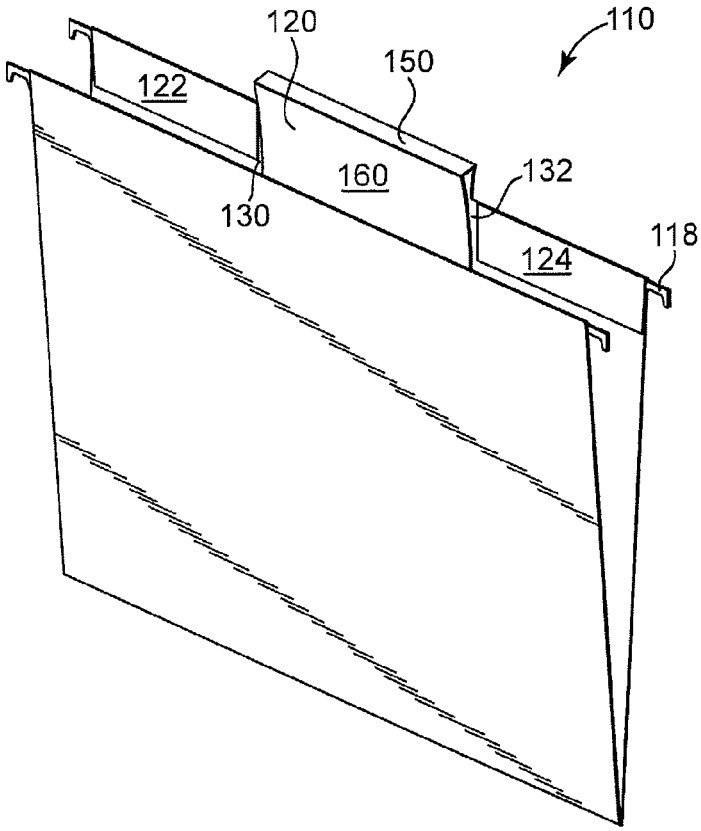
FIG. 4 is a perspective view of an alternative embodiment with a 3 dimension tab.
Figure 5:
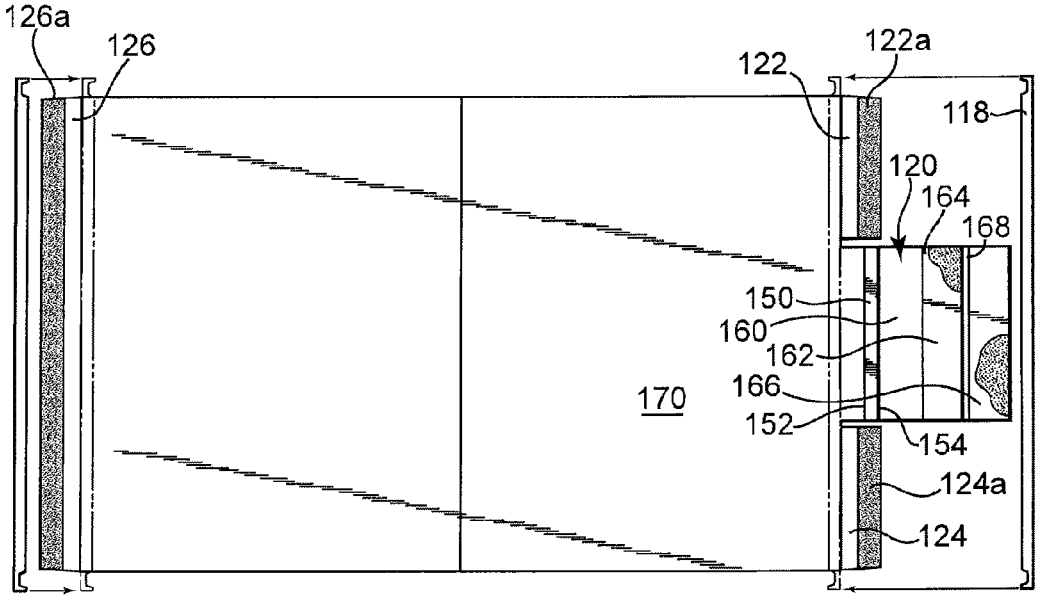
FIG. 5 is a plan view of the embodiment in FIG. 4 with the tab in an unfolded state.
Figure 6:
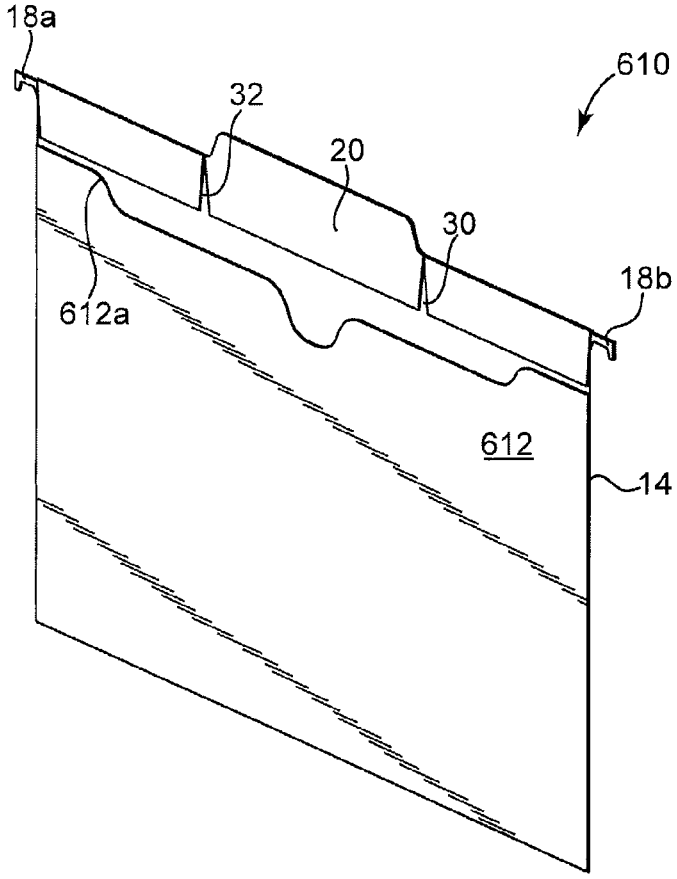
FIG. 6 is a perspective view of a further embodiment with a pocket folder version of either of the above two embodiments.

It also possible to combine the features of the invention in FIGS. 1-3 with additional features shown in FIGS. 4-5. (To the extent the elements are the same, they are indicated with the same numerals incremented by "100", so that element 10 will become element 110).

The embodiment shown in FIGS. 4-5 shows a center tab. As in the case with the previous embodiment, it may have left or right tabs (not shown). In an alternate embodiment the tab is provided as a separate unit, initially fully detached from the folder itself. In this embodiment, the entire tab 120 with multiple folds is a separate unit which includes means for affixation, such as mentioned elsewhere herein, to affixed 3-D tab to the edge of any ordinary file to provide a 3-D tab adjacent, instead of, or over an existing tab. In such case, the most peripheral portions of tab 120 may be made longer to provide extra affixation surfaces. It is also envisioned in this invention that these peripheral portions may have flanges which can be received by the standard slots in hanging files, with flanges and affixation means (such as adhesive) the 3-D tab is convertible, that is, affixable by means of flanges or adhesive means. Exemplary flanges which mate with hanging folder slots may be seen in Pendaflex® plastic tab sku 991109 sold by Officedepot.com hereby incorporated by reference. The flanges extend generally radially away from the body of the tab to align with like mating slots on the top of such hanging folders as is well known in the art. The advantage of this system is a dual affixation method for those files which have slots, the flanges can be used, and those without, the adhesive means is available.

Tab section 120 may be a rectangular element with several subsections and fold lines. The first section is a substantially rigid reinforcement strip 150 having fold lines 152, 154 on both sides thereof. This rigid section forms the upper edge of the 3-dimensional tab as seen in FIG. 4. In the preferred embodiment, it is made of a card stock material similar to the folder itself, but backed by a rigidifying strip, such as a plastic inlay or overlay. The preferred version has the plastic inlay affixed on what become the inner surfaces, so that when the tab is fully constructed, the rigidifying strip will be out of sight. In an alternate embodiment a rigidifying strip is omitted. Fold lines (scores) are preferably provided and may suffice to eliminate the need for rigidifying strip or portion.

The next tab section 160 extends from fold line 154 and may have an adhesive on its inner surface. An optional first section 160 is separated from a successive section 162 by a fold line, or crease 164, followed by a further option section 166 separated by fold line or crease 168. Some or all of the section may have adhesive or have removable strips covering adhesive. Note that adhesive, affixation means, or adhesive means, is meant to be interpreted broadly as being any attachment means, including mechanical (pins, fasteners, staples, etc), welds, Velcro®, etc.

When folded as shown in FIG. 4, a three dimensional tab is constructed. Notice that portion 160 is capable of been viewed from an angle parallel with the front or rear panels/leaves whereas the tab portion 150 is roughly perpendicular (or other selected angle such as 30 or 45 degrees), or "generally L-shaped" meaning roughly 90 degrees with respect to panel 14. The exact angle depends on user preference, the length of the various panels or the affixation point of panels 160, 162, 166. The further down the length of panel or leaf 170 any of panels 160, 162 or 166 are affixed, the more acute the angle of the panel 150 will be. An obtuse angle for panel 150 is likewise achievable by opposite placement. For example, the angle between portions 150 and 160 is determined by point at which elements 160 or 162 or 166 are affixed to the inside of panel 170. Further, by selective affixation of the various portions the angle of the label can be adjusted to any angel desired from 0-180 degrees. Perpendicular is most common, but a 45 degree angle could be useful for top tab folder viewed from a file drawer.

In the preferred embodiment, the optional panels 162, 166 have adhesive which, by removing a protective strip, is adhered to panel 14 at a point where portion 150 is substantially perpendicular to panel 170. Creases 164, 168 provide for a change in slope between the portions.

In this embodiment, gaps 130, 132 are shown merely as notches, but they could be also be V-shaped in the previous embodiment.

The description of the invention including its applications and advantages as set forth herein is illustrative and is not intended to limit the scope of the invention, which is set forth in the claims. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

A method of making a file folder to have an integral flat or 3 dimensional tab system is also disclosed. In one embodiment the method includes providing (or cutting a folder face having) an extension piece extending from an edge of the folder, cutting notches between adjacent portions of the extension piece, folding one of the extension pieces such that it has a tab portion higher than other portions, when folded, or folding one extension into a triangular shape and affixed the free end of the triangle to the folder, thereby creating a surface which is generally perpendicular (or other selected angle) to the surface of the folder.

The invention claimed is:

1. A hanging file folder having a pair of support bars to be carried on spaced apart rails and having an integral display tab for which the user can select the desired display angle, comprising:

a) first and second panels having top and bottom edges and inner and outer surfaces, said bottom edges being joined to form a folder with inner surfaces facing each other;

b) the top edge of said first panel having a foldable portion to maintain a support bar therebetween; the top edge of said second panel having a foldable portion configurable to create a three dimensional protruding display tab which extend above said top edge, said display tab comprising:

1. a first extension section of predetermined width dimension, extending from and integral with said top edge of said second panel;
2. an intermediate section connected to said extension section having a pair of parallel fold lines on either side of thereof;
3. an attachment section extending from said intermediate section at one of said fold lines; an adhesive for selective affixation thereof at various angles by affixing said inner surface of said second panel to said attachment section at one of a plurality of user selectable location to create a tab with the intermediate section having a selectable display angle of 0-180 degrees by user selective affixation;

so that said folder includes an integral three dimensional display tab viewable at a selectable angle.

2. The folder of claim 1 wherein said intermediate section is more rigid than said first extension section.

3. The folder of claim 1 wherein said intermediate section includes a rigidifying material.

4. The folder of claim 1 wherein said attachment section includes a hook and loop repositional adhesive which allows selective affixation at various display angles.

5. The folder of claim 1 wherein said folder is formed from a blank and wherein said blank includes said first and second panels and said extension as a unitary item.

6. A hanging file folder having a pair of support bars to be carried on spaced apart rails and having an integral display tab, comprising:

a) first and second panels having top and bottom edges and inner and outer surfaces, said bottom edges being joined to form a folder with inner surfaces facing each other;

b) the top edge of said first panel having a foldable portion to maintain a support bar therebetween;

c) the top edge of said second panel having at least a pair of integral foldable portions, a first foldable portion configured to maintain a support bar therebetween and a second integral foldable portion, being narrower than the width of the top edge and configurable to create a three dimensional protruding display tab which extend above said top edge, said display tab comprising:

1. a first extension section of predetermined width dimension, extending from said top edge of said second panel;
2. an intermediate section connected to said extension section having a pair of parallel fold lines on either side of thereof;
3. an attachment section extending from said intermediate section at one of said fold lines; an affixation means for user selective affixation of the inner surface of said second panel with said attachment section at a user selectable location to create a tab with the intermediate section having a user selectable display angle of 0-180 degrees; so that said folder includes an integral three dimensional display tab viewable at a user selectable angle.

7. A method making a file folder and an integral three dimensional display tab with user selectable display angle between 0-180 degrees, comprising:

a) providing an integral extension piece extending beyond the portion, extending from an edge of the folder, the extension piece having a proximal end extending from to said folder and a distal free end, b) scoring the piece with two parallel scores, the space between the scores constituting one face of the tab;

c) applying adhesive to portion to the distal end of the extension;

d) providing a region on said the folder for receiving said distal end of said extension at a plurality of users selectable affixation points on the extension on the file folder to permit the user to select any display angle between 0-180 degrees for the tab; so that when said extension piece is folded along said scores, a 3-dimensional tab is formed and is attachable to said folder at a user selectable position to select the desired display angle between 0-180 degrees.

8. The method of claim 7 further including the step of rigidifying the space between said scores.

9. The method of claim 8 wherein the rigidifying further includes the step of affixing an inlay to the space defined between the scores.

10. The method of claim 7 wherein the user may affix the receiving said distal end of said extension with a repositionable hook and loop adhesive.

* * * * *